US005384627A

United States Patent [19]

Behe et al.

[11] Patent Number: 5,384,627

[45] Date of Patent: Jan. 24, 1995

[54] DEVELOPING UNIT HAVING CERAMIC DONOR ROLL

[75] Inventors: Thomas J. Behe; Heiko Rommelmann, both of Webster; Daniel R. Gilmore, III, Fairport; Gerald T. Lioy, Webster, all of N.Y.

[73] Assignee: Xerox Corporation, Stamford, Conn.

[21] Appl. No.: 215,449

[22] Filed: Mar. 21, 1994

[51] Int. Cl.[6] ..... G03G 15/08

[52] U.S. Cl. ..... 355/247; 118/647; 118/654; 355/261

[58] Field of Search ..... 355/247, 249, 259, 261; 118/647, 651, 654, 661; 492/18, 27

[56] References Cited

U.S. PATENT DOCUMENTS

| | | | |
|---|---|---|---|
| 4,868,600 | 9/1989 | Hays et al. | 355/259 |
| 4,984,019 | 1/1991 | Folkins | 355/215 |
| 5,010,367 | 4/1991 | Hays | 355/247 |
| 5,017,967 | 5/1991 | Koga | 355/261 |
| 5,063,875 | 11/1991 | Folkins et al. | 118/651 |
| 5,124,749 | 6/1992 | Bares | 355/261 X |
| 5,166,472 | 11/1992 | Maeda et al. | 118/653 |
| 5,172,170 | 12/1992 | Hays et al. | 355/259 |
| 5,245,392 | 9/1993 | Behe et al. | 355/259 |
| 5,300,339 | 4/1994 | Hays et al. | 355/259 X |
| 5,322,970 | 6/1994 | Behe et al. | 118/651 |

*Primary Examiner*—Robert B. Beatty
*Attorney, Agent, or Firm*—John S. Wagley

[57] ABSTRACT

A developer unit adapted to develop a latent image with toner particles. The unit includes a housing defining a chamber for storing a supply of toner particles in the chamber. The unit also includes a donor roll including an electrically non-conductive circumferential surface having a conductivity less than $10^{-8}$ (ohm-cm)$^{-1}$ and having a central region and opposed marginal regions disposed on either side of the central region with the diameter of the central region being less than the diameter of the opposed marginal regions. The donor roll is spaced from the latent image to form a development zone. The unit further includes an electrode member which is positioned in the development zone adjacent opposed marginal regions and spaced from the central regions of the donor roll. The electrode member is electrically biased to detach toner particles from the donor roll to form a toner powder cloud in the development zone with toner particles from the toner cloud developing the latent image.

10 Claims, 5 Drawing Sheets

DEVELOPING UNIT HAVING CERAMIC DONOR ROLL

The present invention relates to a developer apparatus for electrophotographic printing. More specifically, the invention relates to a donor roll as part of a scavengeless development process.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner." Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner particles to the latent image at a controlled rate so that the toner particles effectively adhere electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll." The developer roll is typically in the form of a cylindrical sleeve rotating around a fixed assembly of permanent magnets. The carrier beads form chains extending from the surface of the developer roll, and the toner particles are electrostatically attracted to the chains of carrier beads. When the magnetic brush is introduced into a development zone adjacent the electrostatic latent image on a photoreceptor, the electrostatic charge on the photoreceptor will cause the toner particles to be pulled off the carrier beads and onto the photoreceptor. Another known development technique involves a single-component developer, that is, a developer which consists entirely of toner. In a common type of single-component system, each toner particle has both an electrostatic charge (to enable the particles to adhere to the photoreceptor) and magnetic properties (to allow the particles to be magnetically conveyed to the photoreceptor). Instead of using magnetic carrier beads to form a magnetic brush, the magnetized toner particles are caused to adhere directly to a developer roll. In the development zone adjacent the electrostatic latent image on a photoreceptor, the electrostatic charge on the photoreceptor will cause the toner particles to be attracted from the developer roll to the photoreceptor.

An important variation to the general principle of development is the concept of "scavengeless" development. The purpose and function of scavengeless development are described more fully in, for example, U.S. Pat. No. 4,868,600 to Hays et al., U.S. Pat. No. 4,984,019 to Folkins, U.S. Pat. Nos. 5,010,367 to Hays, or 5,063,875 to Folkins et al. U.S. Pat. No. 4,868,600 to Hays et al is hereby incorporated by reference. In a scavengeless development system, toner is detached from the donor roll by applying AC electric field to self-spaced electrode structures, commonly in the form of wires positioned in the nip between a donor roll and photoreceptor. This forms a toner powder cloud in the nip and the latent image attracts toner from the powder cloud thereto. Because there is no physical contact between the development apparatus and the photoreceptor, scavengeless development is useful for devices in which different types of toner are supplied onto the same photoreceptor such as in "tri-level"; "recharge, expose and develop"; "highlight"; or "image on image" color xerography.

A typical "hybrid" scavengeless development apparatus includes, within a developer housing, a transport roll, a donor roll, and an electrode structure. The transport roll advances carrier and toner to a loading zone adjacent the donor roll. The transport roll is electrically biased relative to the donor roll, so that the toner is attracted from the carrier to the donor roll. The donor roll advances toner from the loading zone to the development zone adjacent the photoreceptor. In the development zone, i.e., the nip between the donor roll and the photoreceptor, are the wires forming the electrode structure. During development of the latent image on the photoreceptor, the electrode wires are AC-biased relative to the donor roll to detach toner therefrom so as to form a toner powder cloud in the gap between the donor roll and the photoreceptor. The latent image on the photoreceptor attracts toner particles from the powder cloud forming a toner powder image thereon.

Another variation on scavengeless development uses a single-component developer material. In a single component scavengeless development, the donor roll and the electrode structure create a toner powder cloud in the same manner as the above-described scavengeless development, but instead of using carrier and toner, only toner is used.

The electrode wires must be very accurately spaced from the donor roll in order to assure a proper toner powder cloud in the gap between the donor roll and the photoreceptor. In prior art scavengeless development systems as shown in FIG. 2, the donor roll 10 includes a central area 12 with a smaller diameter 13 and two hubs 14 with a larger diameter 15 separated from the central area 12 by grooves 16. The wire 18 is strung between the two hubs, thus spaced from the roll 10 in the central area 12. The larger diameter 15 and the smaller diameter 13 must be accurately maintained to assure the accurate spacing between the electrode wires 18 and the donor roll 10. These prior art donor rolls are typically made of aluminum and anodized to obtain proper electrical properties. It is difficult to maintain the required accurate diameters when machining the aluminum donor roll. This difficulty is exasperated by the subsequent anodizing process, in that the anodizing affects the hubs 14 differently than the central area 12, causing different dimensional changes to these areas. Furthermore the anodized coating is so thin that the roller may not be machined subsequent to anodizing.

The following disclosures may be relevant to various aspects of the present invention:

U.S. Pat. No. 5,172,170 Patentee: Hays et al. Issue Date: Dec. 15, 1992

U.S. Pat. No. 5,010,367 Patentee: Hays Issue Date: Apr. 23, 1991

U.S. Pat. No. 5,063,875 Patentee: Folkins et al. Issue Date: Nov. 12, 1991

U.S. Pat. No. 4,984,019 Patentee: Folkins Issue Date: Jan. 8, 1991

U.S. Pat. No. 4,868,600 Patentee: Hays et al. Issue Date: Sep. 19, 1989

U.S. application Ser. No. 08/164,493 Patentee: Beheet al. Filing Date: Dec. 9, 1993

U.S. application Ser. No. 08/051,403 Patentee: Behe et al. Filing Date: Apr. 23, 1993

U.S. Pat. No. 5,172,170 discloses an apparatus in which a donor roll advances toner to an electrostatic latent image recorded on a photoconductive member. A plurality of electrical conductors are spaced from one another with one of the conductors located in one of the grooves in the donor roll. A dielectric layer is disposed in at least the grooves of the roll interposed between the roll and the conductors and may cover the region between the grooves. The dielectric layer may be fabricated of anodized aluminum or a polymer and may be applied by spraying, dipping or powder spraying. The roll is made from a conductive material such as aluminum and the dielectric layer is disposed about the circumferential surface of the roll between adjacent grooves. The conductive material is applied to the grooves by a coater to form the electrical conductors. A charge relaxable layer is applied over the donor roll surface. The electrical conductors are adapted to be electrically biased in the development zone to detach toner from the donor roll so as to form a toner cloud in the development zone. In the development zone, toner is attracted from the toner cloud to the latent image. In this way, the latent image is developed with toner.

U.S. Pat. No. 5,010,367 discloses a scavengeless non-interactive development system for use in highlight color imaging. To control the developability of lines and the degree of interaction between the toner and receiver, the combination of an AC voltage on a developer donor roll with an AC voltage between toner cloud forming wires and the donor roll enabling efficient detachment of toner from the donor to form a toner cloud and position one end of the cloud in close proximity to the image receiver for optimum development of lines and solid areas without scavenging a previously toned image.

U.S. Pat. No. 5,063,875 discloses an apparatus which develops an electrostatic latent image. A transport roll advances a developer material from a chamber to a donor roll. The donor roll advances the toner particles to the latent image. The latent image attracts toner particles from the donor roll. In order to improve the speed with which toner particles removed from the donor roll are replaced, an alternating voltage is applied between the two rolls.

U.S. Pat. No. 4,984,019 discloses an apparatus in which contaminants are removed from an electrode positioned between a donor roller and a photoconductive surface. A magnetic roller is adapted to transport developer material to the donor roller. The electrode is vibrated to remove contaminants therefrom.

U.S. Pat. No. 4,868,600 discloses a scavengeless development system in which toner detachment from a donor and the concomitant generation of a controlled powder cloud is obtained by AC electrical fields supplied by self-spaced electrode structures positioned within the development nip. The electrode structure is placed in close proximity to the toned donor within the gap between toned donor and image receiver, self-spacing being effected via the toner on the donor.

Co-pending application Ser No. 08/164,493, filed Dec. 9, 1993, discloses an apparatus for developing a latent image recorded in a surface of a flexible photoconductive member. The apparatus comprises a developer unit, positioned opposed from the surface of the flexible photoconductive member, for developing the latent image with developer material and a backing member. The backing member has an arcuate surface in engagement with a surface of the flexible photoconductive member opposed from the surface having the latent image recorded therein. The flexible photoconductive member is wrapped about at least a portion of the arcuate surface of the backing member to form a negative wrap angle opposed from the developer unit.

Co-pending application Ser. No. 08/051,403, filed Apr. 23, 1993, now U.S. Pat. No. 5,322,970 discloses a donor roll for the conveyance of toner in a development system for an electrophotographic printer including an outer surface of ceramic. The ceramic has a suitable conductivity to facilitate a discharge time constant thereon of less than 600 microseconds. The donor roll is used in conjunction with an electrode structure as used in scavengeless development.

According to the present invention, there is a provided a developer unit adapted to develop a latent image with toner particles. The unit comprises a housing defining a chamber for storing a supply of toner particles therein. The unit also comprises a donor roll including an electrically non-conductive circumferential surface having a central region and opposed marginal regions disposed on either side of the central region with the diameter of the central region being less than the diameter of the opposed marginal regions. The donor roll is spaced from the latent image to form a development zone. The unit further comprises an electrode member which is positioned in the development zone adjacent opposed marginal regions and spaced from the central regions of the donor roll. The electrode member is electrically biased to detach toner particles from the donor roll to form a toner powder cloud in the development zone with toner particles from the toner cloud developing the latent image.

There is also provided an electrophotographic printing machine of the type having an electrostatic latent image recorded on a photoconductive member and a developer unit adapted to develop the latent image with toner particles. The improved developer unit comprises a housing defining a chamber for storing a supply of toner particles therein. The unit also comprises a donor roll including an electrically non-conductive circumferential surface having a central region and opposed marginal regions disposed on either side of the central region with the diameter of the central region being less than the diameter of the opposed marginal regions. The donor roll is spaced from the latent image to form a development zone. The unit further comprises an electrode member which is positioned in the development zone adjacent opposed marginal regions and spaced from the central regions of the donor roll. The electrode member is electrically biased to detach toner particles from the donor roll to form a toner powder cloud in the development zone with toner particles from the toner cloud developing the latent image.

There is further provided a method of manufacturing a donor roll for use in developing a latent image. The method comprises the steps of machining a material to form a generally cylindrical electrically conductive substrate, coating the substrate with an electrically nonconductive layer, and machining the electrically conductive layer into a central region and opposed marginal regions disposed on either side of the central region with the diameter of the central region being less than the diameter of the opposed marginal regions.

IN THE DRAWINGS

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 3 printing machine will be shown hereinafter schematically and their operation described briefly with reference thereto.

Figure 3:
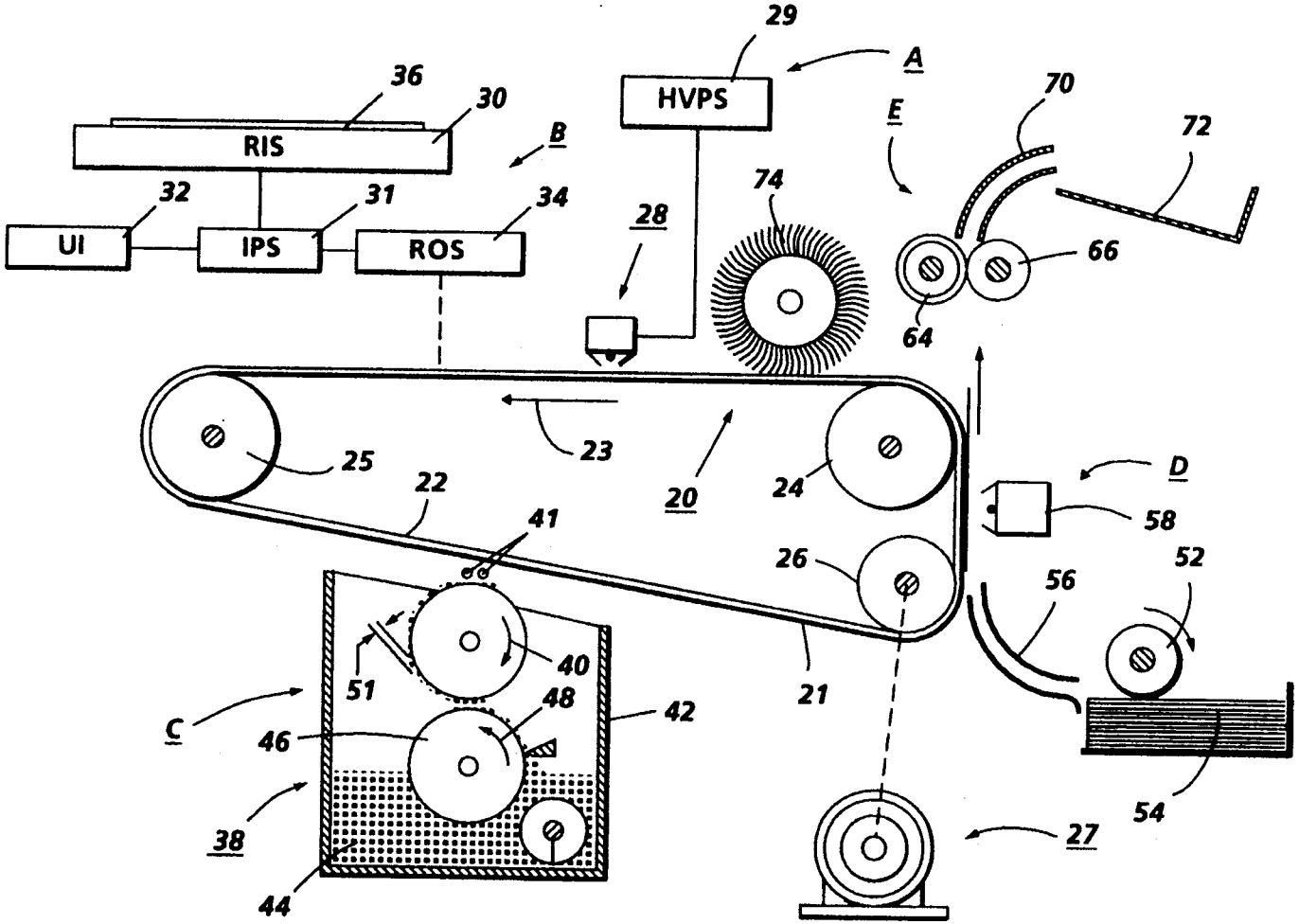
FIG. 3 is a schematic elevational view of an illustrative printing machine incorporating the developer unit of the present invention therein.

Referring initially to FIG. 3, there is shown an illustrative electrophotographic printing machine incorporating the development apparatus of the present invention therein. The printing machine incorporates a photoreceptor 20 in the form of a belt having a photoconductive surface layer 21 on an electroconductive substrate 22. Preferably the surface 21 is made from a selenium alloy. The substrate 22 is preferably made from an aluminum alloy which is electrically grounded. The belt is driven by means of motor 27 along a path defined by rollers 24, 25 and 26, the direction of movement being counter-clockwise as viewed and as shown by arrow 23. Initially a portion of the belt 20 passes through a charge station A at which a corona generator 28 charges surface 21 to a relatively high, substantially uniform, potential. A high voltage power supply 29 is coupled to device 28.

Next, the charged portion of photoconductive surface 21 is advanced through exposure station B. At exposure station B, an original document 36 is positioned on a raster input scanner (RIS), indicated generally by the reference numeral 30. The RIS contains document illumination lamps, optics, a mechanical scanning drive, and a charge coupled device (CCD array). The RIS captures the entire original document and converts it to a series of raster scan lines and (for color printing) measures a set of primary color densities, i.e., red, green and blue densities at each point of the original document. This information is transmitted to an image processing system (IPS), indicated generally by the reference numeral 31. IPS 31 is the control electronics which prepare and manage the image data flow to raster output scanner (ROS), indicated generally by the reference numeral 34. A user interface (UI), indicated generally by the reference numeral 32, is in communication with the IPS. The UI enables the operator to control the various operator adjustable functions. The output signal from the UI is transmitted to IPS 31. The signal corresponding to the desired image is transmitted from IPS 31 to ROS 34, which creates the output copy image. ROS 34 lays out the image in a series of horizontal scan lines with each line having a specified number of pixels per inch. The ROS includes a laser having a rotating polygon mirror block associated therewith. The ROS exposes the charged photoconductive surface of the printer.

After the electrostatic latent image has been recorded on photoconductive surface 21, belt 20 advances the latent image to development station C as shown in FIG. 3. At development station C, a development system 38, develops the latent image recorded on the photoconductive surface. Preferably, development system 38 includes a donor roll or roller 40 and electrode wires 41 positioned in the gap between the donor roll 40 and photoconductive belt 20. Electrode wires 41 are electrically biased relative to donor roll 40 to detach toner therefrom so as to form a toner powder cloud in the gap between the donor roll and photoconductive surface. The latent image attracts toner particles from the toner powder cloud forming a toner powder image thereon. Donor roll 40 is mounted, at least partially, in the chamber of developer housing 42. The chamber in developer housing 42 stores a supply of developer material 44. The developer material is a two component developer material of at least magnetic carrier granules having toner particles adhering triboelectrically thereto. A transport roller 46 disposed interiorly of the chamber of housing 42 conveys the developer material to the donor roller 40. The transport roller 46 is electrically biased relative to the donor roller so that the toner particles are attracted from the transport roller to the donor roller.

Again referring to FIG. 3, after the electrostatic latent image has been developed, belt 20 advances the developed image to transfer station D, at which a copy sheet 54 is advanced by roll 52 and guides 56 into contact with the developed image on belt 20. A corona generator 58 is used to spray ions on to the back of the sheet so as to attract the toner image from belt 20 the sheet. As the belt turns around roller 24, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 21 of belt 20, the residual toner particles adhering to photoconductive surface 21 are removed therefrom by a rotatably mounted fibrous brush 74 in contact with photoconductive surface 21. Subsequent to cleaning, a discharge lamp (not shown) floods photoconductive surface 21 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 1:
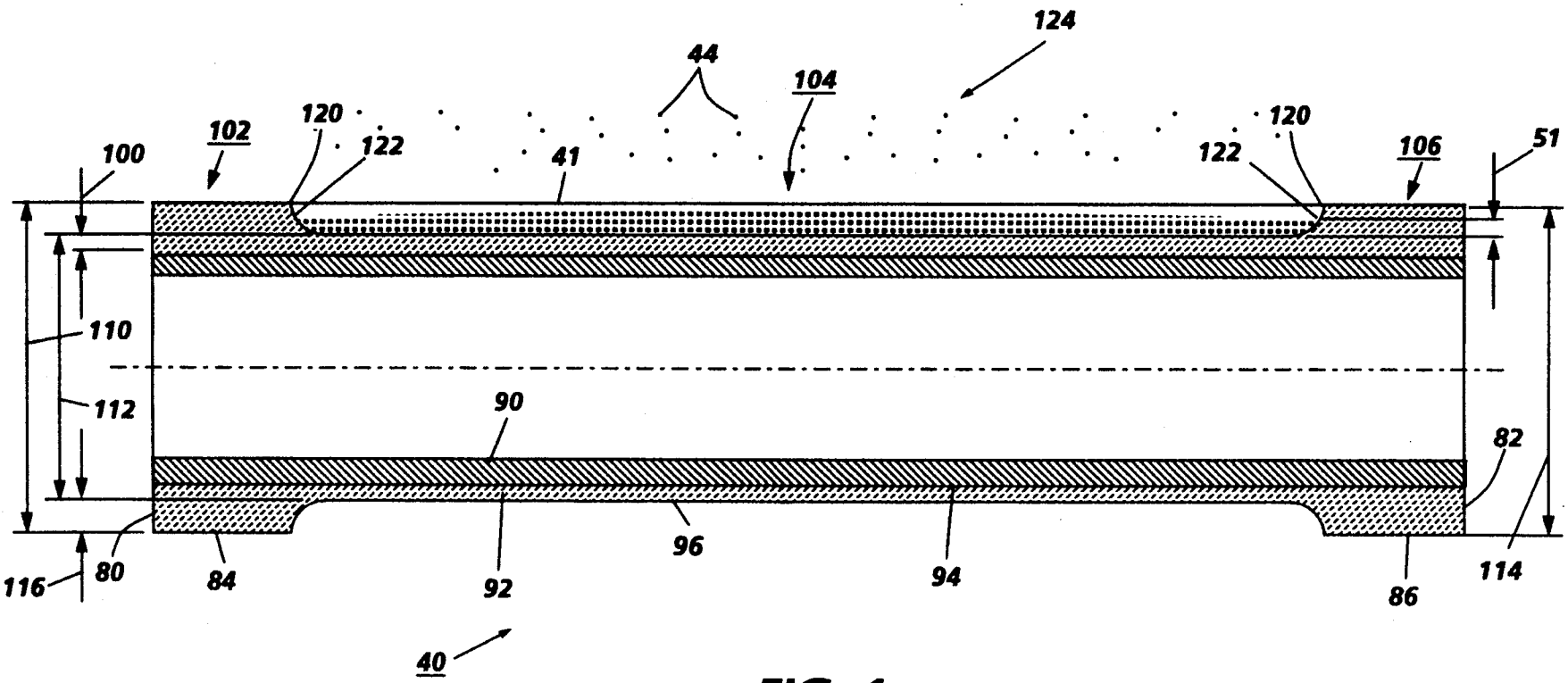
FIG. 1 is an plan view partially in section of an embodiment of the donor roll of the developer unit of the present invention.
Figure 2:
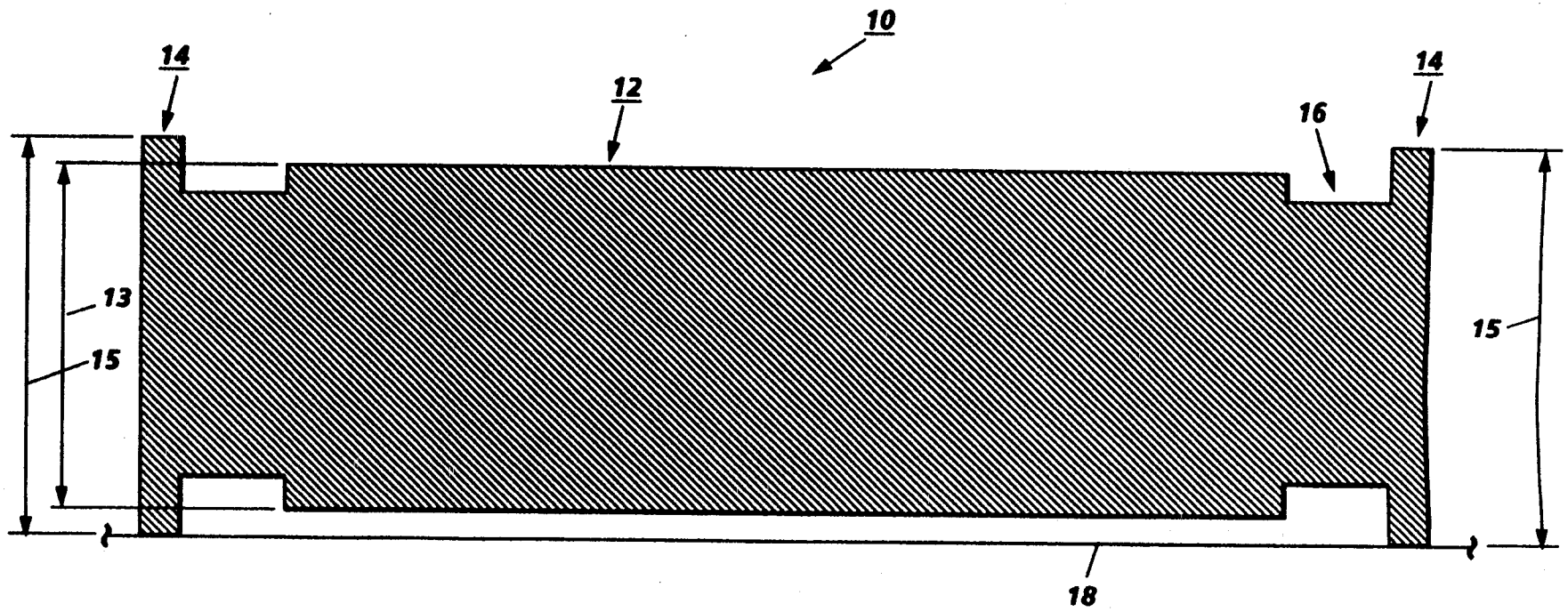
PRIOR ART FIG. 2
FIG. 2 is a plan view in section of a prior art donor roll.

According to the present invention and referring to FIG. 1, the donor roll 40 and the electrode wire 41 are shown. The donor roll 40 preferably has a generally cylindrical elongated shape. The donor roll 40 may be mounted to the development unit 38 (as shown in FIG. 3) by any suitable means such as by journals or bearings which support the donor roll 40 at a first end 80 and at a second end 82. A first stem 84 and a second stem 86 may be provided at the first end 80 and second end 82, respectively, to support the donor roll 40 in the journals (not shown).

The donor roll 40 includes an electrically conductive substrate 90 which preferably is in the form of a cylindrical tube. It should be appreciated, however, that the electrically conductive substrate 90 may take any other suitable form including a solid cylinder. The electrically conductive tube 90 may be made of any suitable conductive material, such as aluminum. The cylindrical tube 90 may be fabricated by any suitable method such as machining or by extruding, but machining may be preferred to assure dimensional accuracy. A layer 92 of a non-conductive material is located on tube periphery 94 of the electrically conductive substrate 90. The non-conductive layer 92 defines a layer periphery 96. The non-conductive layer 92 may be made of any suitable material but preferably is made of a material which has a conductivity less than $10^{-8}$ (ohm-cm)$^{-1}$. Preferably, the layer 92 is made Of a material which may be applied to the tube periphery 94 with a non-conductive layer thickness 100 defined by the distance between the tube periphery 94 and the layer periphery 96 sufficient to permit the subsequent machining of the layer 92.

Preferably, the non-conductive layer 92 is made of a ceramic material. A ceramic is a non-metallic, inorganic compound normally comprised of a blend pure oxide ceramics such as alumina, zirconia, thoria, beryllia, magnesia, spinel, silica, titania, and forsterire, which may be applied as a film to a metal substrate. Ceramics which include at least one of aluminum (AI), boron (B), carbon (C), germanlure (Ge), silicon (Si), titanium (Ti), zirconium (Zr), magnesium (M g), beryllium (Be) and tungsten (W) are particularly hard, highly abrasion resistive, have high resistivity, high dielectric strength, low dielectric loss, and a high dielectric constant and are, therefore, preferred for the donor roll non-conductive layer 92. The material properties of the ceramic are chosen to obtain a preselected conductivity of preferably less than $10^{-8}$(ohm-cm)$^{-1}$.

The ceramic layer 92 may be applied to the aluminum tube 90 by any suitable process such as sputtering, ion-plating, vacuum evaporation or plasma spraying. Plasma spraying is preferred for optimum control of the properties of the aluminum tube 90 and the ceramic layer 92.

Preferably, the donor roll 40 includes a first end zone 102 adjacent the first end 80, a central zone 104, centrally located within the donor roll 40, and a second end zone 106 located adjacent the second end 82. It should be appreciated that the end zones 102 and 106 may include the stems 84 and 86 as shown in FIG. 1 or the stems 84 and 86 may likewise extend beyond the end zones 102 and 106. The layer periphery 96 defines a first end zone diameter 110 within the first end zone 102, a central diameter 112 within the central zone 104, and a second end zone diameter 114 located within the second end zone 106. The end zone diameters 110 and 114 are generally the same size, while the central zone diameter 112 is smaller than both the first end zone diameter 110 or the second end zone diameter 114. The central diameter 112 is concentric with the end diameters 110 and 114. A step 116 is thus formed between the second end diameter 114 and central diameter 112 as well as between the first end diameter 110 and the central diameter 112. Typically the step 116 is 24 microns +/−14 microns. The step 116 may be defined by the formula:

[(end diameter 110 or 114)—(central diameter 112)]÷2

Electrode wires 41 are strung between ceramic layer periphery 96 at first end zone 102 to the ceramic layer periphery 96 at the second end zone 106. While only one electrode wire 41 is shown in FIG. 1, it should be appreciated that a plurality of wires may preferably be used for proper development. The electrode wires 41, thus, are spaced from the layer periphery 96 within the central zone 104 by a distance equal to the step 116. Preferably, to ease the manufacture of the donor roll 40 and to minimize stress risers, the layer periphery between the central zone 104 and the second end zone 106 as well as the area between the first end zone 102 and the central zone 104 is blended. For example, the layer periphery 96 between the first zone 102 and the central zone 104 and between the second end zone 106 and the central zone 104 may be defined by edge radii 120 and fillet radii 122.

Referring again to FIG. 3, the developer unit 38 includes a developer housing 42 which supports the donor roll 40. The developer housing 42 contains a supply of developer particles 44. A transport roll 46 is used to transport the particles 44 from a lower portion of the developer unit 38 to an area between the transport roll 46 and the donor roll 40. The toner particles thus move first along the transport roll 46 in the direction of arrow 48 to the donor roll 40 and along the donor roll 40 in the direction of arrow 50. The developer particles 44 which adhere to the donor roll 40 as it rotates has a layer thickness 51. These particles 44 progress further along the direction of arrow 50 to the electrode wires 41.

Referring again to FIG. 1, the step 116 is preferably slightly greater than the layer thickness 51 in order to optimize the formation of a powder cloud 124 near the layer periphery 96. The electrode wires 41 are electrically biased to assist in the formation of the powder cloud 124, the toner particles 44 progressing along the donor roll in the thickness 51, approach the electrode wires 41 which are electrically biased and form the powder cloud 124.

The thickness 100 of the ceramic layer 92 forming ceramic layer periphery 96 is between 0.127 and 3.180 mm, on a donor roll 40 having a total outer diameter of approximately 25 mm. It should be appreciated that the donor roll 40 may function equally as well with a total outer diameter of more or less than 25 mm. The ceramic thickness 100 represents a compromise between the concerns of ceramic material cost and grinding cost. It has been found that this ceramic coating is particularly well suited for the design parameters of a donor roll in scavengeless development, either of a magnetic brush or a single component variety.

Figure 4:
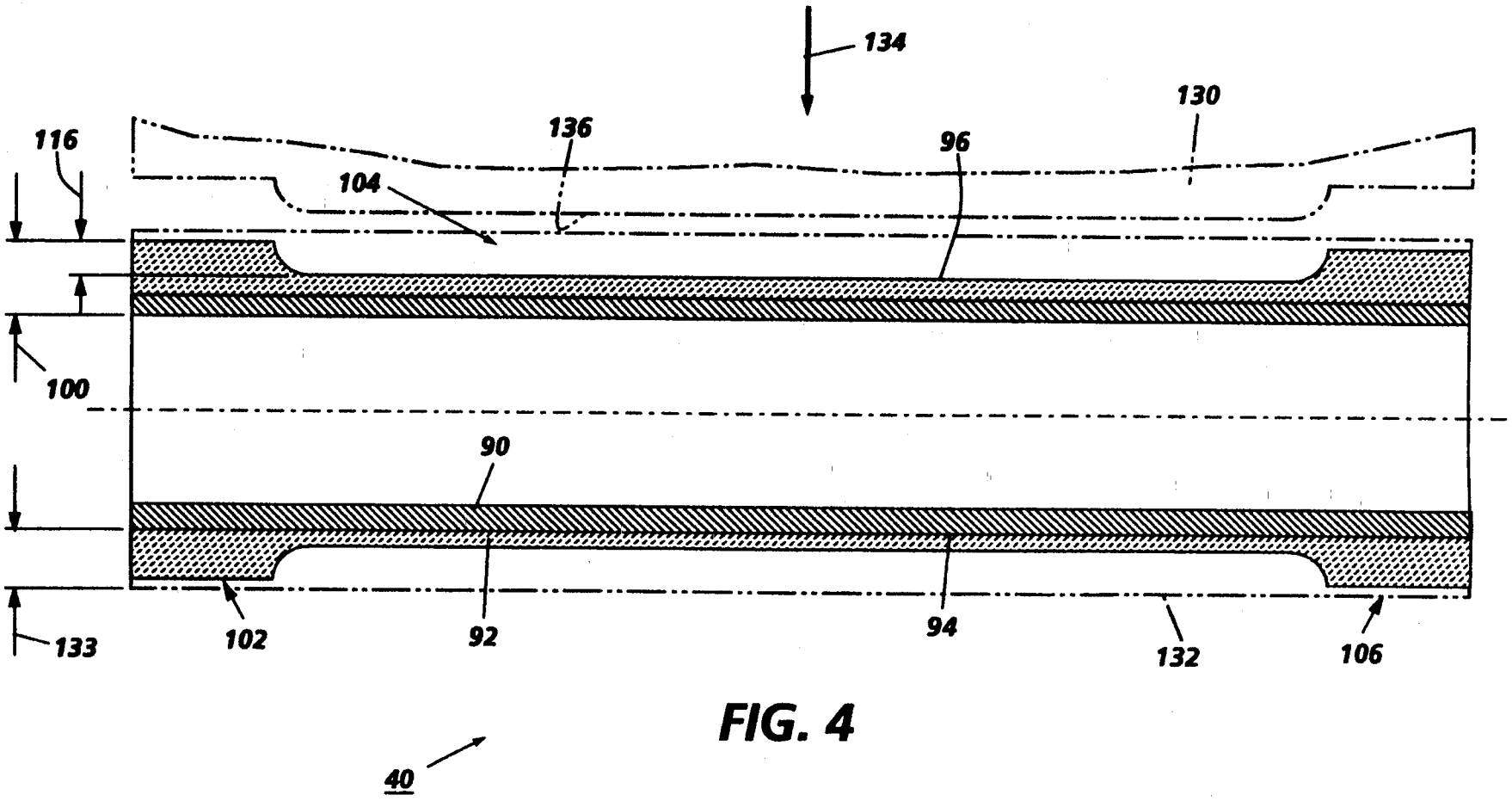
FIG. 4 is a plan view in section of an embodiment of the donor roll of the developer unit of the present invention illustrating a first style of grinding wheel used to grind the roll in phantom.

Now referring to FIG. 4, the donor roll 40 is shown with a contoured grinding wheel 130 spaced from the donor roll 40. The donor roll 40 is shown with an unground ceramic layer periphery 132 in phantom. The unground layer periphery 132 extends beyond the ceramic layer periphery 96 both at the end zones 102 and 106, as well as in the central zone 104. The unground layer periphery 132 and the substrate periphery define an unground layer thickness 133 slightly larger than the thickness 100 at the end zones 102 and 106. The contoured grinding wheel 130 is typical for use with a plunge type grinder where the wheel 130 moves radially inward toward the donor roll 40, the grinding wheel 130 and the donor roll simultaneously rotate and the grinding wheel 130 moves slowly inwardly in the direction of arrow 134 and grinds the donor roll 40. The grinding wheel 130 has a grinding wheel periphery 136 which is a mirror image of the layer periphery 96 including the step 116. Grinding is a particularly well suited method of machining the ceramic material in order to provide the step 116. The grinding wheel 130 thus very accurately establishes the step 116.

Figures 5, 5A:
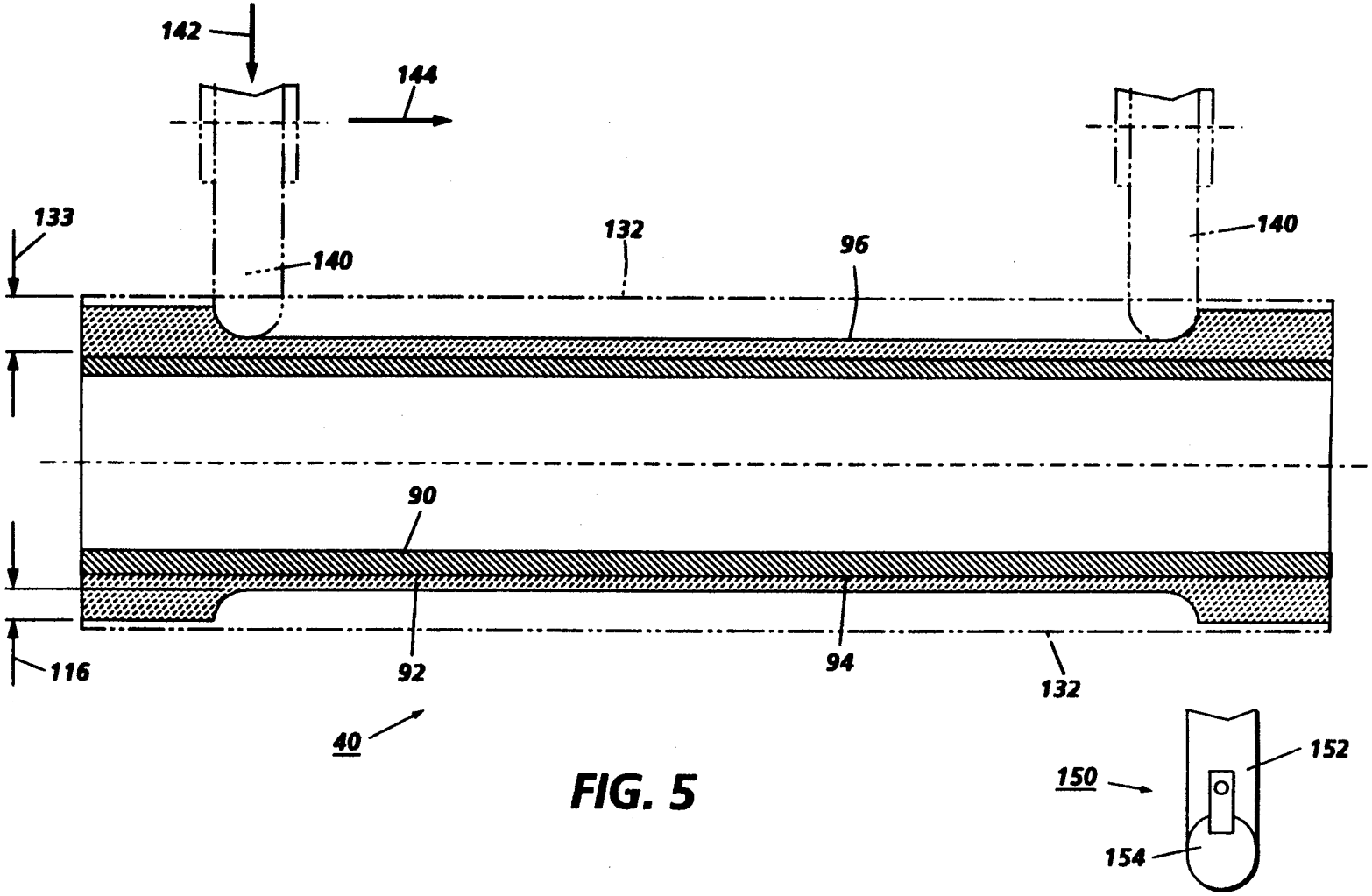
FIG. 5 is a plan view in section of an embodiment of the donor roll of the developer unit of the present invention illustrating a second style of grinding wheel used to grind the roll in phantom.
FIG. 5A is a partial plan view of a turning tool which may alternatively be used to machine the roll.

Now referring to FIG. 5, the donor roll 40 is shown with a disc shaped grinding wheel 140. The grinding wheel 140 is suitable for use with a contouring type of grinding machine (not shown) which moves the grinding wheel radially toward the donor roll 40 in the direction of arrow 142 as well as axially along the length of the donor roll 40 in the direction of arrow 144. As with the grinding wheel 130 of FIG. 4, the grinding wheel 140 removes a portion of the ceramic layer 92 thereby generating layer periphery 96 and assuring accuracy to the step 116.

Now referring to FIG. 5A, turning tool 150 may be used to remove a portion of the ceramic layer 92 to form the ceramic layer periphery 96 by utilizing a contouring turning machine (not shown) in a method similar to the grinding machine (not shown) in the grinding wheel 140 of FIG. 5. The turning tool 150 includes a tool holder 152 which holds an insert 154. The insert 154 has a shape similar to the grinding wheel 140 of FIG. 5. The motion of the turning tool 150 with respect to the donor roll 40 is identical to the motion of the grinding wheel 140 of FIG. 5 relative to the donor roll 40.

Because the ceramic coating may be made with relatively thick walls, the thickness of the walls can be exploited to insure that surface abnormalities such as craters or pin holes are kept to a minimum. The use of a plasma spray method of applying the ceramic coating results in a much more uniform periphery geometry than that obtained from anodizing. Because the ceramic coating is relatively easily worked, it is possible to grind down such a cylinder to a small extent to insure precise dimensions. The diameters of the central zone and the end zones may therefore be held with great precision during the grinding operation. The use of an aluminum substrate with a plasma sprayed ceramic coating which is subsequently machined, thus provides for a very accurate stepped roller which can very accurately space the electrode wires from the donor roll.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A developer unit wherein said donor adapted to develop a latent image with toner particles, comprising:

a housing defining a chamber for storing a supply of toner particles therein;

a donor roll including an electrically non-conductive circumferential surface having a conductivity less than $10^{-8}$ (ohm-cm)$^{-1}$ and having a central region and Opposed marginal regions disposed on either side of the central region with the diameter of the central region being less than the diameter of the opposed marginal regions, said donor roll being spaced from the latent image to form a development zone; and an electrode member, positioned in the development zone adjacent opposed marginal regions and spaced from the central regions of said donor roll, said electrode member being electrically biased to detach toner particles from said donor roll to form a toner powder cloud in the development zone with toner particles from the toner cloud developing the latent image.

2. A developer unit as in claim 1, wherein said donor roll further comprises an electrically conductive substrate.

3. A developer unit as in claim 1, wherein the diameter of the central region is 20–75 microns less than the diameter of opposed marginal regions.

4. An electrophotographic printing machine of the type having an electrostatic latent image recorded on a photoconductive member and a developer unit adapted to develop the latent image with toner particles, wherein the improved developer unit comprises:

a housing defining a chamber for storing a supply of toner particles therein;

a donor roll including an electrically non-conductive surface having a conductivity less than $10^{-8}$ (ohm-cm)$^{-1}$ and having a central region and opposed marginal regions disposed on either side of the central region with the diameter of the central region being less than the diameter of the opposed marginal regions, said donor roll being spaced from the latent image to form a development zone; and an electrode member, positioned in the development zone adjacent opposed marginal regions and spaced from the central regions of said donor roll, said electrode member being electrically biased to detach toner particles from said donor roll to form a toner powder cloud in the development zone with toner particles from the toner cloud developing the latent image.

5. A printing machine as in claim 4, wherein said donor roll further comprises an electrically conductive substrate.

6. A printing machine as in claim 4, wherein the diameter of the central region is 20–75 microns less than the diameter of opposed marginal regions.

7. A developer unit adapted to develop a latent image with toner particles, comprising:

a housing defining a chamber for storing a supply of toner particles therein;

a donor roll including an electrically non-conductive circumferential surface having a conductivity less than $10^{-8}$ (ohm-cm)$^{-1}$, said donor roll being spaced from the latent image to form a development zone; and an electrode member, positioned in the development zone and spaced from said donor roll, said electrode member being electrically biased to detach toner particles from said donor roll to form a toner powder cloud in the development zone with toner particles from the toner cloud developing the latent image.

8. A developer unit as in claim 7, wherein said donor roll further comprises an electrically conductive substrate.

9. An electrophotographic printing machine of the type having an electrostatic latent image recorded on a photoconductive member and a developer unit adapted to develop the latent image with toner particles, wherein the improved developer unit comprises:

a housing defining a chamber for storing a supply of toner particles therein;

a donor roll including an electrically non-conductive surface having a conductivity less than $10^{-8}$ (ohm-cm)$^{-1}$, said donor roll being spaced from the latent image to form a development zone; and an electrode member, positioned in the development zone and spaced from said donor roll, said electrode member being electrically biased to detach toner particles from said donor roll to form a toner powder cloud in the development zone with toner particles from the toner cloud developing the latent image.

10. A printing machine as in claim 9, wherein said donor roll further comprises an electrically conductive substrate.

* * * * *